US005083719A

United States Patent [19]

Kremar

[11] Patent Number: 5,083,719

[45] Date of Patent: Jan. 28, 1992

[54] DOUBLE TIRE REEL SPOOL STARTER

[75] Inventor: Djuro Kremar, Quebec, Canada

[73] Assignee: Valmet-Dominion, Inc., Lachine, Canada

[21] Appl. No.: 538,042

[22] Filed: Jun. 13, 1990

[30] Foreign Application Priority Data

May 3, 1990 [CA] Canada ..... 2,016,013

[51] Int. Cl.[5] ..... B65H 18/00

[52] U.S. Cl. ..... 242/66

[58] Field of Search ..... 242/65, 66, 67.1 R, 242/67.2, 67.5

[56] References Cited

U.S. PATENT DOCUMENTS

| | | | |
|---|---|---|---|
| 2,399,418 | 4/1946 | Wood | 242/67.1 R |
| 2,787,427 | 4/1957 | Marczincin | 242/56 |
| 2,860,839 | 11/1958 | Bower | 242/56 |
| 2,865,264 | 12/1958 | Moser | 93/58.2 |
| 3,086,403 | 4/1963 | Knerr et al. | 74/242.9 |
| 3,140,620 | 7/1964 | Ferara | 74/221 |
| 3,202,374 | 8/1965 | Phelps | 242/65 |
| 3,239,155 | 3/1966 | Kinoshita | 242/66 |
| 3,310,246 | 12/1966 | McClean | 242/2 |
| 3,568,944 | 3/1971 | Besserdich | 242/66 |
| 3,698,658 | 10/1972 | Skei | 242/67.5 X |
| 3,727,856 | 4/1973 | Kitch | 242/67.5 X |
| 3,889,892 | 6/1975 | Melead | 242/56 R |
| 4,099,682 | 7/1978 | Beruska | 242/67.1 R X |
| 4,146,187 | 3/1979 | Steiner et al. | 242/56 R |
| 4,171,780 | 10/1979 | Bugnone | 242/56 R |
| 4,186,893 | 2/1980 | Kolosov et al. | 242/67.2 X |
| 4,194,702 | 3/1980 | Ploeg | 242/66 X |
| 4,204,650 | 5/1980 | Mengel | 242/56 R |
| 4,602,750 | 7/1986 | Hjortnas | 242/67.2 |
| 4,657,196 | 4/1987 | Irish et al. | 242/66 X |
| 4,744,720 | 5/1988 | Kremar | 414/748 |

FOREIGN PATENT DOCUMENTS

| | | | |
|---|---|---|---|
| 1449665 | 1/1969 | Fed. Rep. of Germany | 242/66 |

*Primary Examiner*—Daniel P. Stodola
*Assistant Examiner*—John P. Darling

[57] ABSTRACT

A reel bar drive for use with a web winding system, such as the dry end of a paper making machine has a pair of driving wheels adapted to make driving contact with a peripheral end portion of a reel bar. The driving wheels are mounted on a pivotal platform located to one side of the winder. The platform is pivotable in an arcuate path having a component direction relative to the axis of the reel bar so as to move the driving wheels into driving relation with a peripheral end portion of the reel bar. Owing to the pivotal mounting arrangement, the position of the driving wheels are adjustable to compensate for changes in the reel bar position as it commences its web reeling operation. The reel bar drive may utilize its self weight to enhance frictional contact between the drive wheels and the reel bar. Upon withdrawal of the supporting platform, the drive wheels are displaced completely clear of the winding system. Thus, the reel bar drive is suitable for use with a reel bar auto-loading system and facilitates safe maintenance of component parts of the reel bar drive.

12 Claims, 1 Drawing Sheet

DOUBLE TIRE REEL SPOOL STARTER

FIELD OF THE INVENTION

This invention is directed to a rotational drive arrangement for a reel bar, and in particular, to a reel bar drive system for use in a web winding arrangement.

BACKGROUND OF THE INVENTION

Rotary reel bars are widely used, in the reeling and winding of endless web material such as paper webs in the pulp and paper industry, and in printing.

In the paper making industry, where a wide paper web is generated at high speed as a continuous web, it is essential to provide reel bars in the winder section of the machine with a rotational capability, so that substantially uninterrupted reeling of the web can be maintained.

In the case of slitting machines, while the machine requirements may be somewhat less demanding in regard to the continuity of reel bar availability, the need to provide a reel bar drive is substantially the same.

Certain aspects of prior art reel bar drives may be found in U.S. Pat. No. 2,865,264 issued Dec. 23, 1958 to Moser; U.S. Pat. No. 3,140,620 issued Jul. 14, 1964 to Ferara; and, U.S. Pat. No. 3,889,892 issued Jun. 17, 1975 to Melead. Moser teaches the use of a slitter-scorer machine having a continuously driven fixed shaft with a rubber faced wheel such as an aircraft tire to engage a peripheral end portion of the reel bar. The arrangement is inflexible in that the drive arrangement is immobile moreover, the transmittable torque is limited by the single frictional contact of the wheel on the reel bar.

Ferara teaches the use of a timing belt having a toothed or cogged surface entrained in frictional driven relation with a main drive pulley in order to overcome the friction-limited provisions of Moser.

Melead illustrates certain of the aspects of reel bar positioning and transfer that may be embodied in a winding apparatus.

The reel bar drive arrangements of Moser and Ferara are handicapped in use by their complexity and inflexibility, and in the case of Moser, by the limited torque transfer capability of a single driving surface.

SUMMARY OF THE INVENTION

In accordance with the present invention there is provided a reel bar drive movably mounted for lateral displacement relative to an axis of a reel bar in a web winding device.

The subject reel bar drive of the present invention may be displaced or moved relative to the reel bar while driving the reel bar to allow the position of a reel bar to vary during winding in a web winding drive, without loss of driving contact between reel bar and drive.

In one embodiment the reel bar drive includes a pair of driven wheels movable into driving relation with a peripheral portion of a reel bar mounted in a web winding device.

In a preferred embodiment the reel bar drive is mounted for retraction clear of the web winding device and is utilized to initiate rotation of the reel bar prior to it being moved into a winding position within a web winding device.

The present invention thus preferably provides a reel bar drive for use in a web winding device. The drive has a pair of driving wheels in mutually spaced relation to contact a peripheral surface of a reel bar in driving torque transfer relationship therewith. A drive means and transmission means are provided for rotatably driving the driving wheels. The reel bar drive includes drive displacement means for moving the driving wheels, drive means and transmission means laterally to the side and remotely of the reel bar to permit displacement of the reel bar within the winding device.

It should be understood that the displacement of the reel bar will preferably involve its movement from a pre-winding position into a winding position driven by a surface drive in the web winding device.

In the reel bar drive the drive displacement means has a supporting platform to which the driving wheels, drive means and transmission means are mounted. The drive displacement means also includes powered actuator means for selectively displacing the supporting platform from a first position having the driving wheels in contacting driving relation with a reel bar, to a second position wherein the driving wheels are clear of the reel bar.

In one embodiment the drive displacement means includes guidance means for guiding the position of the supporting platform.

In the preferred embodiment the supporting platform is mounted on a plurality of pivoting links and the powered actuator means displaces the driving wheels laterally, in axially displaced relation relative to the axis of the reel bar.

The subject embodiment is arranged wherein the supporting platform is positioned such that in an operative condition the axes of rotation of the driving wheels are maintained substantially parallel with the axis of rotation of the reel bar.

In the preferred embodiment the drive displacement means has a piston and cylinder actuator extensible from a first contracted condition wherein the driving wheels are retracted clear of the web winding device, to a second extended condition wherein the driving wheels are brought in radially displacement driving relation with an end portion of a reel bar. Location of the reel bar drive in its operative condition, having the wheels thereof supported by including supporting links, in positioned relation above the reel bar, permits the application of a portion of the self weight of the reel bar drive in downward friction developing relation of the driving wheels against the reel bar.

In the preferred embodiment the supporting links of the support platform are of substantially uniform length, located laterally of the winding drive, whereby in an operative, reel engaging position the links are inclined inwardly towards the winding device such that actuation of the powered actuator means in a load applying sense produces a downward component of force on the driving wheels, in load increasing relation on the reel bar.

BRIEF DESCRIPTION OF THE DRAWINGS

Certain preferred embodiments of the invention are described by way of example, without limitation of the invention thereto, reference being made to the accompanying drawings, wherein.

DETAILED DESCRIPTION OF THE PREFERRED EMBODIMENTS

Figure 1:
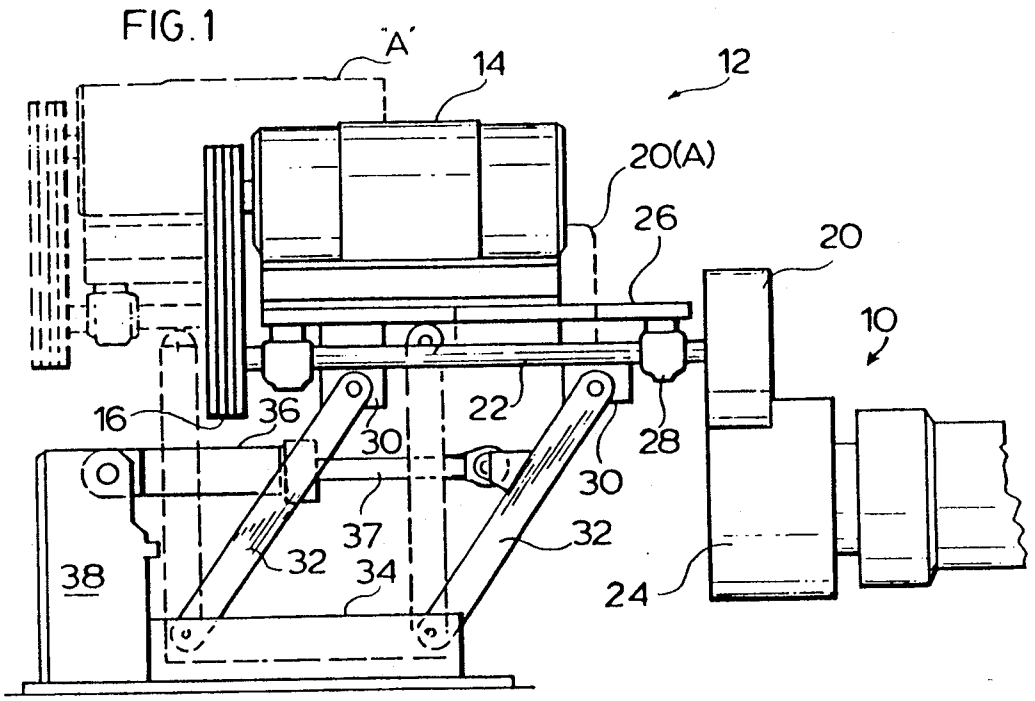
FIG. 1 is a schematic end view of a portion of a winding device having a reel bar drive in accordance with the present invention.
Figure 2:
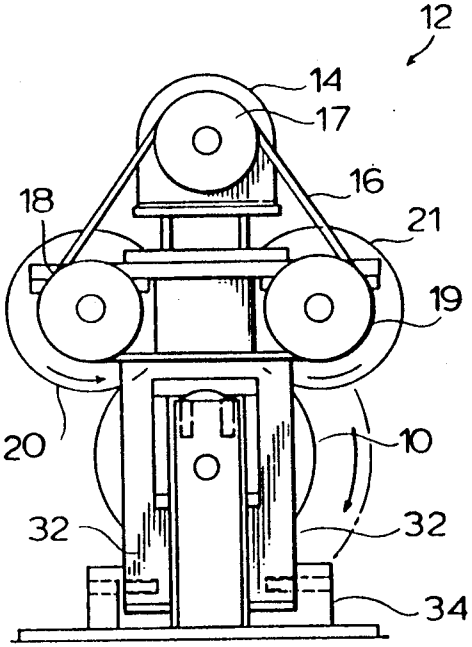
FIG. 2 is a side view, looking end wise on to the reel bar drive of FIG. 1.

Referring to FIGS. 1 and 2, an axial end portion 10 of a reel bar is shown. The reel bar is preferably mounted in a paper machine dry end, or alternatively in the reel end of a reeler slitter. In the case of a paper machine reeler, this preferably includes an auto loader where empty reel bars are loaded automatically from above in an initial pre-winding reeling position as shown. The reel bar drive 12 brings the reel bar 10 up to winding speed by center driving.

The reel bar drive 12 comprises an electric motor 14 connected by multiple vee belts 16 and pulleys 17, 18 and 19 in driving relation with a pair of wheels 20, 21.

The wheels 20, 21 are each carried upon a shaft 22 and are preferably shod with pneumatic tires to provide a durable and reliable low drag high friction drive to collar portion 24 of reel bar 10.

A supporting platform 26 has the electric motor 14 mounted thereon and shafts 22 suspended therebeneath by way of bearing blocks 28. Platform supports 30 have the upper ends of links 32 pivotally secured thereto. The lower ends of links 32 are pivotally secured to baseplate 34.

A fluid powered double acting piston and cylinder actuator 36 is pivotally attached to pedestal 38, having the piston rod 37 pivotally connected with one of the four links 32.

The actuator 36 is preferably pneumatically actuated, on account of its paper machine environment, and has a forward, engaged position as illustrated in FIG. 1 in full line, with the wheels 20 engaging the reel bar 10 peripheral collar portion 24 in driving relation. Circumstantial changes in the height location of reel bar 10 can be accommodated by reposition of piston rod 37. The actuator 36 also serves as a resilient spring to maintain torque transferring frictional engagement of wheels 20 with collar portion 24 of reel bar 10.

In the retracted position "A" of reel bar drive 12, shown in phantom in FIG. 1, the wheels 20 are moved leftwardly, clear of the reel bar 10. This is rapidly and readily performed by reversing the pneumatic load on piston rod 37 and pivoting the links 32 upwardly against a stop portion of pedestal 38. It will be evident that when the wheels are in this retracted condition, the reel bar 10 is totally unrestricted for displacement and operation in the paper machine. At the same time the various elements of the reel bar drive 12 are made readily accessible for servicing at the side of the paper machine.

Alternative platform mounting arrangement are contemplated, wherein the platform is supported on profiled rails, wherein the respective rates of approach, axially and radially to the reel bar collar portion 24 may be predetermined by the inclination of the rail selected, while in the retracted condition of the reel drive 12 the location or attitude of the platform necessary for optimum servicing utility may be selected.

It will be understood that in operation the presently disclosed reel bar drive 12 offers the advantages of:

enhanced torque transfer due to increased contact area;

improved traction, due to location of the reel bar in semi-sandwiched relation between the driving tires;

capability of continuing operation with one driving wheel in the event of tire failure on one wheel;

facilitates the use and operation of auto-loaders for auto loading of reel bars;

possesses capability to drive the reel bar in reeling action until effective contact is made with the drum of the winder.

It will be understood that the scope of the present invention is not limited to the illustrated embodiments, but is better defined in the scope of the accompanying claims.

What I claim as new and desire to secure by Letters Patent of the United States of America is:

1. A reel bar drive for use in a web winding device for winding a substantially continuous web onto a rotating reel bar, said reel bar drive being positioned adjacent to one side of the web winding device and including:

a pair of driving wheels in mutually spaced relation adapted to contact a peripheral surface of said reel bar in driving and torque transfer relationship therewith;

drive means for rotatably driving through transmission means said drive wheels; and, drive displacement means for moving the drive means, the transmission means and the driving wheels together laterally away from the one side of the web winding device and out of driving contact with said reel bar to permit displacement of the reel bar within the winding device.

2. The reel bar drive as set forth in claim 1, said drive displacement means having a supporting platform to which said drive means, said transmission means and said driving wheel are mounted; said drive displacement means including guidance means for guiding movement of said supporting platform; and, said drive displacement means including a powered actuator means for selectively displacing the supporting platform from a first position having said driving wheel in contacting, driving relation with said reel bar, to a second position wherein said driving wheel is displaced clear of said reel bar.

3. The reel bar drive as set forth in claim 2, said guidance means including at least one arm to provide a predetermined path of travel to said reel bar drive.

4. The reel bar drive as set forth in claim 2, said at least one driving wheel moves in an arcuate descending path into engagement with a collar end of said reel so as to initiate rotation of the reel bar by center driving.

5. The reel bar drive as set forth in claim 2, said guidance means includes a plurality of pivoting links onto which said supporting platform is mounted; said powered actuator means displacing said supporting platform laterally axially displaced from said reel bar.

6. The reel bar drive as set forth in claim 5, said pivoting links being of substantially uniform length and located laterally of said winding device whereby, when in an operative, reel bar engaging position, said links are inclined inwardly towards said winding device, such that actuation of said powered actuator means in a horizontal linear direction is translated by said pivoting links to produce a downward component of force on said driving wheels, in load increasing relation with said reel bar.

7. The reel bar drive as set forth in claim 1, wherein the axes of rotation of said driving wheels are maintained substantially parallel with the axis of rotation of said reel bar in said first driving position and said second position clear of said reel bar.

8. The reel bar drive as set forth in claim 1, said reel bar drive being supported above said reel bar, in at least one position of said reel bar, to permit application of at least a portion of the self weight of the reel bar drive in friction developing relation of said driving wheels against said reel bar.

9. A reel bar drive for use in a web winding device for winding a substantially continuous web onto a rotating reel bar, said reel bar drive being positioned adjacent to one side of the web winding device and including:

at least one driving wheel adapted to contact a peripheral surface of said reel bar in driving and torque transfer relationship therewith;

drive means for rotatably driving through transmission means said drive wheel; and, drive displacement means for moving the drive means, the transmission means and the driving wheel together laterally away from the one side of the web winding device and out of driving contact with said reel bar to permit displacement of the reel bar within the winding device, the drive displacement means including:

a supporting platform to which the drive means, the transmission means and the driving wheel are mounted;

guidance means for guiding movement of the supporting platform;

a powered actuator means for selectively displacing the supporting platform, said powered actuator means including a piston and cylinder actuator extensible from a first, contracted condition, wherein said driving wheel is retracted clear of said reel bar drive, to a second, extended condition, wherein said driving wheel is brought in radially displaced driving relation with an end portion of said reel bar.

10. The reel bar drive as set forth in claim 9, said pivoting links being of substantially uniform length and located laterally of said winding device whereby, when in an operative, reel bar engaging position, said links are inclined inwardly towards said winding device, such that actuation of said powered actuator means in a horizontal linear direction is translated by said pivoting links to produce a downward component of force on said driving wheels, in load increasing relation with said reel bar.

11. The reel bar drive as set forth in claim 10, said at least one driving wheel moves in an arcuate descending path into engagement with a collar end of said reel so as to initiate rotation of the reel bar by center driving.

12. A reel bar drive for use in a web winding device for winding a substantially continuous web onto a rotating reel bar, said reel bar drive being positioned adjacent to one side of the web winding device and including:

at least one driving wheel adapted to contact a peripheral surface of said reel bar in driving and torque transfer relationship therewith, said at least one driving wheel moving in an arcuate descending path into engagement with a collar end of said reel so as to initiate rotation of the reel bar by center driving;

drive means for rotatably driving through transmission means said drive wheel; and, drive displacement means for moving the drive means, the transmission means and the driving wheel together laterally away from the one side of the web winding device and out of driving contact with said reel bar to permit displacement of the reel bar within the winding device.

* * * * *